United States Patent [19]

Rainville

[11] Patent Number: 5,032,104

[45] **Date of Patent: * Jul. 16, 1991**

[54] FRONT OPENING BRASSIERE FOR EASY ACCESS AND REMOVAL BY A HANDICAPPED PERSON

[76] Inventor: Francine J. Rainville, 303 Fleet Dr., Beaconsfield, Québec, Canada, H9W 5X8

[ * ] Notice: The portion of the term of this patent subsequent to Apr. 17, 2007 has been disclaimed.

[21] Appl. No.: 469,771

[22] Filed: Jan. 24, 1990

[51] Int. Cl.[5] ..... A41C 3/02

[52] U.S. Cl. ..... 450/58; 450/36; 2/101; 2/271

[58] Field of Search ..... 450/17, 18, 31, 33, 450/36, 58, 70, 71, 122; 2/101, 217, 271

[56] References Cited

U.S. PATENT DOCUMENTS

| | | | |
|---|---|---|---|
| 1,272,427 | 7/1918 | Haderlein | 450/58 X |
| 1,672,770 | 6/1928 | Mountain | 2/101 |
| 2,117,103 | 5/1938 | Rabensdorf | 450/17 X |
| 2,760,199 | 8/1956 | Champagne | 450/58 X |
| 2,882,905 | 4/1959 | Barg | 450/58 |
| 3,066,676 | 12/1962 | Kaupp | 450/58 |
| 3,173,420 | 3/1965 | Mazzoni | 450/58 X |
| 3,968,803 | 7/1976 | Hyman | 450/58 |
| 4,072,255 | 2/1978 | Bogorad . | |
| 4,289,137 | 9/1981 | Dell et al. | 2/67 X |
| 4,325,378 | 4/1982 | Wilkinson | 450/58 X |

FOREIGN PATENT DOCUMENTS

| | | | |
|---|---|---|---|
| 200041 | 9/1938 | Switzerland | 450/36 |
| 839586 | 6/1929 | United Kingdom | 450/36 |

OTHER PUBLICATIONS

Gershman, "Self-Adhering Nylon Tapes", 168 J.A.M.A., No. 7, Oct. 18, 1958.

*Primary Examiner*—Werner H. Schroeder
*Assistant Examiner*—Jeanette E. Chapman
*Attorney, Agent, or Firm*—Shlesinger, Arkwright & Garvey

[57] ABSTRACT

A brassiere for handicapped people provides detachable and adjustable fabric fastening pads to temporarily hold the two halves together, and finger loops for those who cannot grip. The brassiere has a front opening with an overlapping portion joined to one brassiere cup which overlaps an underlapping portion joined to the other cup. Detachable and adjustable fabric fastening pads or the like are provided on the underside of the overlapping portion to engage with one or more corresponding support pads on the top surface of the underlapping portion. Fabric loops for fingers are provided attached to the overlapping and underlapping portions to avoid a person having to grip the edges of the two portions.

14 Claims, 3 Drawing Sheets

FRONT OPENING BRASSIERE FOR EASY ACCESS AND REMOVAL BY A HANDICAPPED PERSON

FIELD OF THE INVENTION

The present invention relates to a brassiere suitable for the handicapped. More specifically, the present invention provides a front opening brassiere which may be accessed and removed by handicapped people, particularly those with arthritis.

BACKGROUND OF THE INVENTION

Handicapped people, particularly those with arthritis, often have difficulties in accessing and removing garments, because of the difficulty in attaching and detaching hooks and eyes, zippers, buttons and the like. For most people, dressing and undressing is an everyday occurrence that requires little time and thought. However, those people who are disabled and somewhat uncoordinated, who have diseases that affect the nervous system, or those people having inflammation of the joints, particularly those having arthritis, find the task of dressing and undressing both time consuming and difficult. Some handicapped persons require assistance in dressing and undressing, but many disabled people must fend for themselves. Regular brassieres are hooked at the back, which can be difficult to attach and detach for those people who lack coordination or cannot grip a strap. Other types of brassieres are hooked at the front, but generally have a series of small hooks and eyes which require good hand coordination to join together. Neither type of brassiere can easily be joined by those people who cannot grip.

SUMMARY OF THE INVENTION

The present invention provides a brassiere which has a front opening with an overlapping portion joined to one brassiere cup which overlaps an underlapping portion joined to the other cup. Adjustable fabric fastening means such as one or more fastening pads are provided on the underside of the overlapping portion to engage with one or more corresponding support means on the top surface of the underlapping portion of the brassiere cup or on a portion of the brassiere cup itself. Fabric loops are also provided to avoid having to grip the edges of the overlapping and underlapping portions. An individual can put her fingers through the loops and pull the two portions together. A positive attachment means such as a large hook and eye is then provided which can be engaged while holding the portions with the loops and without having to grip and hold the overlapping and underlapping portions in the correct alignment because they are already held in place by the fastening means. Thus, a wearer uses the fastening means to hold the overlapping and underlapping portions together, and makes the positive attachment of these portions, such as by way of engaging a large hook and eye, by pulling the two halves of the brassiere with the finger loops.

According to a first broad aspect of the present invention, there is provided a front opening brassiere for easy access and removal by a handicapped person, said brassiere comprising:

brassiere cups having at least one joining piece extending around the back of a wearer;

one brassiere cup having a center underlapping portion, the other cup having a center overlapping portion which extends over the underlapping portion between the brassiere cups;

adjustable top and bottom fabric fastening means, said means being disposed in a spaced apart relationship on the underside of the overlapping portion to engage with corresponding support means located on the top side of the brassiere cup with the underlapping portion;

positive attachment means between the underside of the overlapping portion and a top side of the underlapping portion, said positive attachment means being located between said top and bottom fabric fastening means;

at least one fabric loop extending from an edge of the overlapping portion to assist in gripping the overlapping portion of the brassiere cup for access or removal;

whereby said top and bottom fabric fastening means and corresponding support means, in conjunction with said fabric loop, are adapted to position said overlapping portion with respect to said underlapping portion to thereby facilitate the engagement and disengagement of said positive attachment means.

According to a second broad aspect of the present invention, there is provided a front opening brassiere for easy access and removal by a handicapped person, said brassiere comprising:

brassiere cups having at least one joining piece extending around the back of wearer; one brassiere cup having a center underlapping portion, the other cup having a center overlapping portion which extends over the underlapping portion between the brassiere cups;

adjustable fabric fastening means, said means being disposed on the top side of the underlapping portion to engage with a corresponding support means located on the underside of the brassiere cup with the overlapping portion;

at least one positive attachment means between the underside of the overlapping portion and the top side of the underlapping portion, said positive attachment means being located adjacent said fabric fastening means;

at least one fabric loop extending from an edge of the overlapping portion to assist in gripping the overlapping portion of the brassiere cup for access or removal;

whereby said fabric fastening means and corresponding support means, in conjunction with said fabric loop, are adapted to position said overlapping portion with respect to said underlapping portion to thereby facilitate the engagement and disengagement of said positive attachment means.

BRIEF DESCRIPTION OF THE DRAWINGS

In drawings which illustrate embodiments of the present invention.

DETAILED DESCRIPTION OF THE PREFERRED EMBODIMENTS

Figure 1:
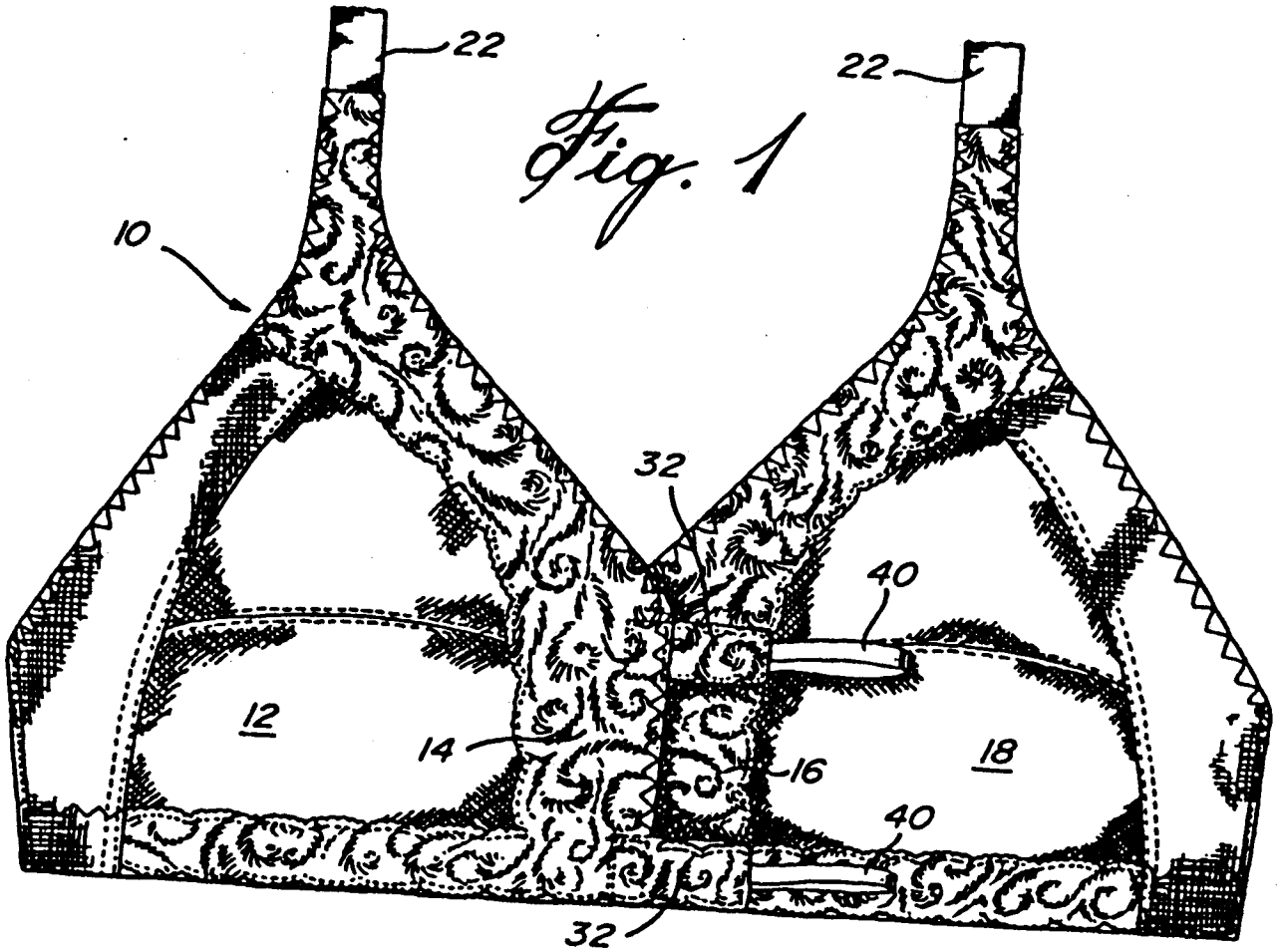
FIG. 1 is a front view of a front opening brassiere according to one embodiment of the present invention.
Figure 2:
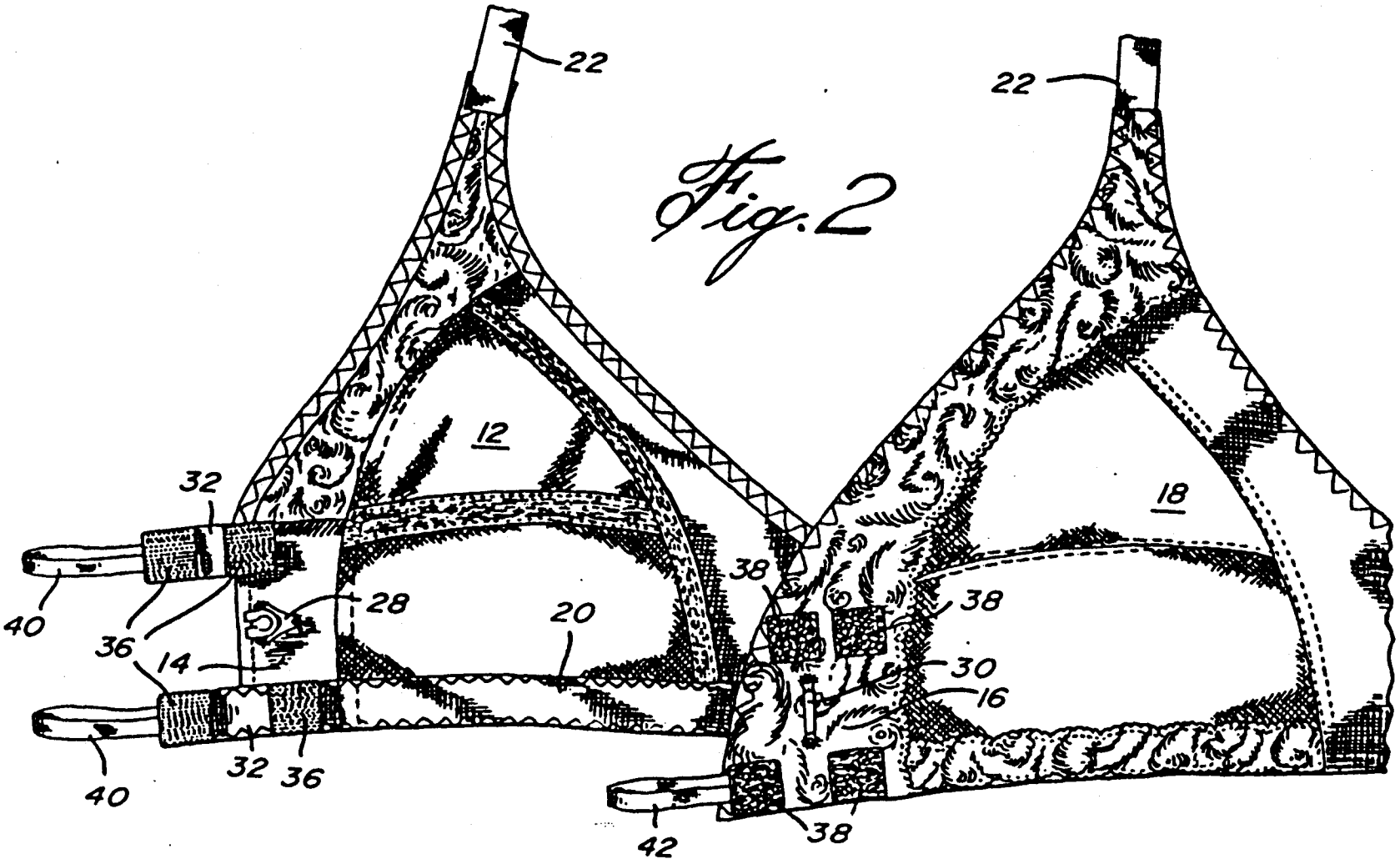
FIG. 2 is a schematic side view of the brassiere shown in FIG. 1 in the open form.

Referring now to the drawings, the front of the brassiere 10 is shown in FIG. 1 with one brassiere cup 12 having an overlapping portion 14 at its center overlapping and underlapping portion 16 of a second brassiere cup 18. A strap or back piece 20 as shown in FIG. 2 extends around the back of a wearer and shoulder straps 22 are provided from the top of the two brassiere cups 12 and 18 extending over the shoulders with adjustable straps (now shown) to connect with the back piece 20. Whereas the brassiere is shown in the drawings to have shoulder straps, it will be apparent to those skilled in the art that different designs of brassiere, some with straps and some being of the underwire support type that do not have straps, may also be made with the front opening design of the present invention.

As may be seen more clearly in FIG. 2, the overlapping portion 14 has on the underside, at the approximate center of the edge, a large hook 28 which is designed to fit into an eye 30 attached to the top side of the underlapping portion 16. The hook 28 and eye 30 are larger than those normally used with brassieres and other garments, so they may be easily joined together by those persons with coordination problems. In effect, the design is similar to those used on the waistband of trousers, pants and the like.

On each side of the hook 28, on the overlapping portion 14, are fabric strips 32 extending from the top and bottom edge of the overlapping portion 14 with square adjustable fabric fastening pads 36 attached on the underside of the strips. Whereas these pads 36 are shown as being square, they may be round, oval, or substantially any shape, but are preferably not strips having a large contact surface area as it may be found that handicapped people do not have the strength to separate such large fabric fastening strips. Whereas two pads are shown on each fabric strip 32, it would be apparent to those skilled in the art that more than two pads 36 may be provided. For a large size brassiere, it is preferred to have more hooks 28 and eyes 30 to provide a stronger connection, however, more fastening pads are not necessarily required as they do not hold the halves together permanently.

Support pads 38 are provided on the top surface of the underlapping portion 16 to mate with the fastening pads 36 on the fabric strips 32. In a preferred embodiment, the fastening pads 36 and support pads 32 are formed of VELCRO, hook and loop type fasteners the trade mark for a fastening system wherein one pad has nylon hooks, and the support pad or other pad has a series of loops into which the hooks engage. For the purpose of the presently described embodiment, the fastening pads 36 include the pads with the nylon hooks therein and the support pads 38 include the pads with the loops. Alternatively, these pads may be reversed with the support pads 38 having the nylon hooks.

Fabric loops 40, which may be of ribbon material, are attached to the ends of the fabric strips 32. These loops 40 can be used by inserting a finger through a loop for those who cannot grip. A further fabric loop 42 is provided at the lower edge of the underlapping portion 16 so that when a wearer first closes the brassiere, she has the finger or fingers of one hand through the loop 40 of the bottom fabric strip 32, the finger or fingers of the other hand through the loop 42 attached to the lower edge of the underlapping portion 16. She then pulls the edges together and allows the fastening pads 36 to engage and hold to the support pads 38. When this has been done, and still with fingers through the loop 40 of the top strip 32, she pulls the overlapping portion 14 across her body so the fastening pads 36 on the top strip are engaged with the support pads 38 on the underlapping portion. In the case where a person does not have the strength to pull, she may put a finger or thumb through a loop and then push the two portions together. The brassiere is now partially closed and it is merely necessary for the wearer to move the loops to engage the hook 28 on the underside of the overlapping portion 14 with the eye 30 on the top side of the underlapping portion 16. This can be achieved without having to put a strain on the joining halves of the brassiere as the overlapping portion 14 and the underlapping portion are already temporarily held together by fastening pads 36 and the support pads 38.

The hook 28 and eye 30 are fairly large to allow the wearer to easily mate them together. They are kept in place by the fastening pads 36 engaging with the support pads 38. Thus, even if there is little or no tension on the hook 28 and eye 30, they do not separate.

Because the fastening pads 36 and the support pads 38 are detachable and adjustable, it is simple to detach them and move them from one position to another so that the fabric straps 32 lie flat on the underlapping portion. Whereas a hook 28 and eye 30 are shown herein, other types of positive attachment means may be provided, such as two or more smaller hook and eyes or a button arrangement. It is preferred, however, that the center attachment is a more positive attachment than the fastening pads 36 and support pads 38.

Figure 3:
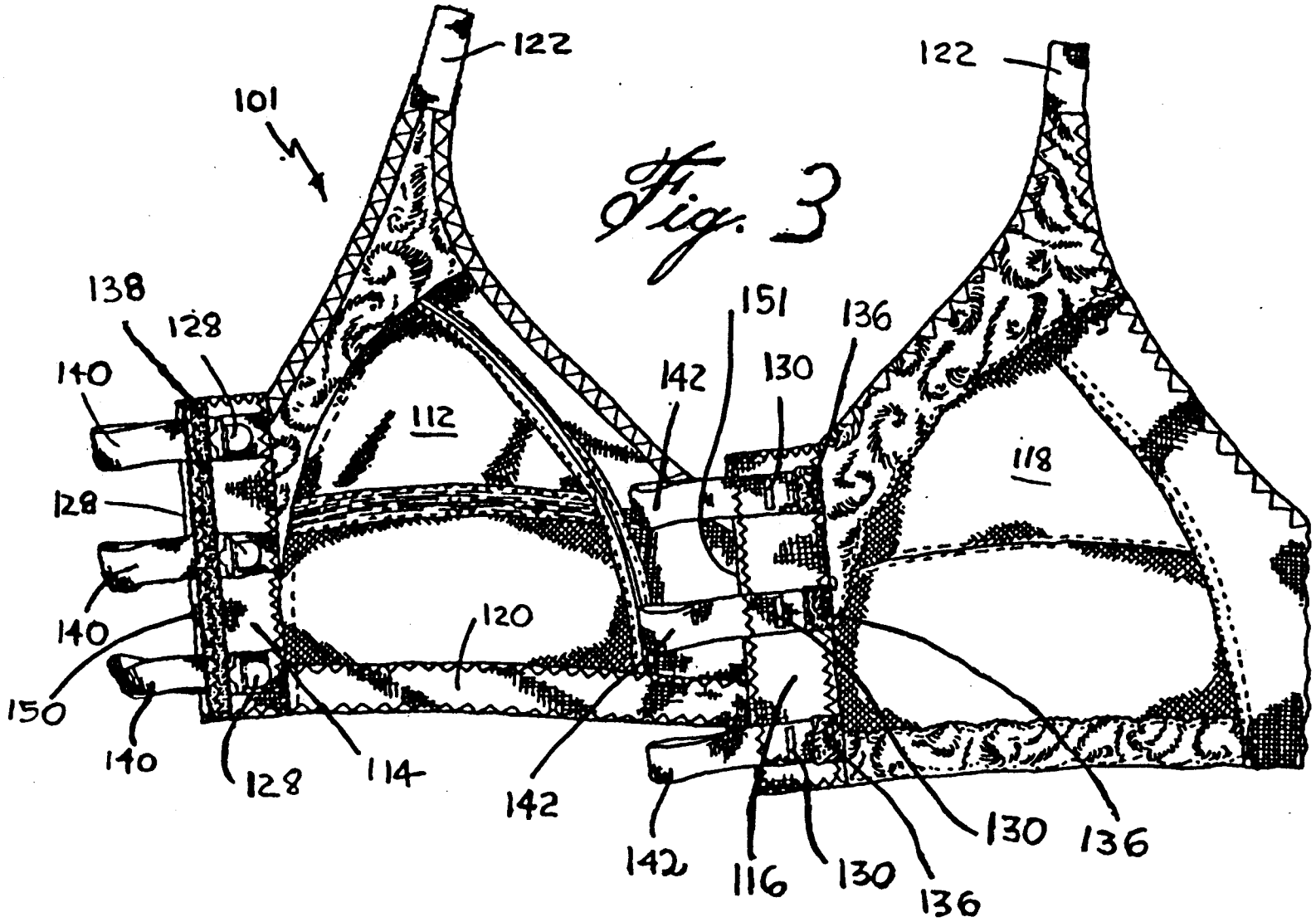
FIG. 3 is a schematic side view of a brassiere in the open form depicting another embodiment of the present invention.

Referring now to FIG. 3 of the drawings, there is depicted another embodiment of the present invention which may be employed with a brassiere 101 similar to that of FIGS. 1 and 2. The brassiere 101 has a first brassiere cup 121 having an overlapping portion 114 at its center which overlaps an underlapping portion 116 of a second brassiere cup 118. A strap or back piece 120 extends around the back of a wearer and shoulder straps 122 are provided from the top of the two brassiere cups 121 and 118 extending over the shoulders of the wearer with adjustable straps (not shown) to connect with the back piece 120.

The overlapping portion 114 has, on its underside and immediately adjacent the leading edge 150 thereof, a continuous support pad 138 in the form of a narrow strip. A plurality of large hooks 128 is also provided on the underside of the overlapping portion in a generally linear arrangement adjacent said continuous support pad 138. The hooks 128 are designed to fit into corresponding eyes 130 attached to the top side of the underlapping portion 116. Both the hooks 128 and eyes 130 perform the same function and are of similar construction to the hook 28 and eye 30 previously described in the first embodiment of the present invention. In the specific embodiment described herein, three sets of hooks 128 and eyes 130 are employed, but those skilled in this art will appreciate that any number of such hooks may be used in order to provide a stronger or more positive connection, where so desired. Extending from the edge 150 of overlapping portion 114 is a plurality of fabric loops 140, preferably corresponding to the number of hooks 128 employed with the brassiere. As previously described, these loops are provided so that a handicapped person may avoid having to grip the edges of the overlapping and underlapping portions when closing the brassiere.

The eyes 130 attached to the top side of the underlapping portion 116 are disposed in a generally linear arrangement immediately adjacent the leading edge 151 of the underlapping portion. A plurality of fabric fastening pads 136 are also disposed in a generally linear arrangement adjacent said eyes 130, with the eyes being located between the edge 151 and the said pads 136. The fabric fastening pads 136 are for mating with the support pad 138 so as to facilitate the engagement and disengagement of the hook and eyes 128, 130 as previously described in the first embodiment of the present invention. Although three such fabric fastening pads have been illustrated in FIG. 3, those skilled in this art will appreciate that any number of pads may be provided in order to achieve the function of facilitating access and removal of the brassiere by a handicapped person. Such pads need not necessarily be arranged in a linear configuration, so long as they are disposed adjacent the positive attachment means, which in the specific embodiment of FIG. 3 comprises a hook and eye mechanism. Other positive attachment means will be evident to those skilled in this art, as was described hereinabove. Moreover, it is to be noted that any number of distinct pads or a continuous pad may be provided for either the fabric fastening means or the mating support means therefor, so long as the total contacting surface areas of such pads is not such as to make the separation or detachment thereof exceedingly difficult for a handicapped person.

As is the case for the overlapping portion 114, the underlapping portion 161 provides a plurality of fabric loops 142 extending from the leading edge 151 of the said underlapping portion, which loops preferably correspond to the number of eyes 130 employed with the brassiere.

In the illustrated embodiment of FIG. 3, the fastening pads 136 and the support pad 138 are formed of VELCRO hook and loop type fasteners. As explained above, any of the fastening means or the support means therefor may comprise VELCRO hook and loop type fastener pads having nylon hooks, the corresponding mating pads therefor comprising VELCRO hook and loop type fasteners pads having loops for engaging said nylon hooks. In the embodiment of FIG. 3, all the fastening pads 136 are of the type having nylon hooks, and the support pad 138 is illustrated as being of the type having loops for said nylon hooks.

In operation, the embodiment of FIG. 3 is analogous to that of the previously described embodiment. A handicapped person who cannot grip may insert a finger through any of the fabric loops 140 or 142, for instance, a finger or fingers of one hand through one or more of the loops 140 of the overlapping portion and a finger or fingers of the other hand through one or more of the loops 142 of the underlapping portion of the brassiere. She may then pull the edges 150, 151 of the brassiere together and allow the fastening pads 136 to mate with the support pad 138, thereby partially closing the brassiere. The wearer then may appropriately manipulate the loops to engage the hooks 128 with the corresponding eyes 130 in order to achieve a positive attachment of the brassiere.

Various changes may be made to the embodiments described herein, for instance, a jabot or front flap with VELCRO or other attachment means may be provided to cover the joint between the overlapping portion and the underlapping portion of the brassiere, the present invention being limited only by the following claims.

The embodiments of the invention in which an exclusive property or privilege is claimed are defined as follows:

1. A front opening brassiere for easy access and removal by a handicapped person, said brassiere comprising:

brassiere cups having at least one joining piece extending around the back of the wearer;

one brassiere cup having a center underlapping portion, the other cup having a center overlapping portion which extends over the underlapping portion between the brassiere cups;

adjustable top and bottom fabric fastening means, said means being disposed in a spaced apart relationship on the underside of the overlapping portion to engage with corresponding support means located on the top side of the brassiere cup with the underlapping portion;

positive attachment means between the underside of the overlapping portion and a top side of the underlapping portion, said positive attachment means being located between said top and bottom fabric fastening means;

at least one fabric loop extending from an edge of the overlapping portion to assist in gripping the overlapping portion of the brassiere cup for access or removal;

whereby said top and bottom fabric fastening means and corresponding support means, in conjunction with said fabric loop, are adapted to position said overlapping portion with respect to said underlapping portion to thereby facilitate the engagement and disengagement of said positive attachment means.

2. The brassiere according to claim 1, wherein said top and bottom fabric fastening means are disposed on the underside of corresponding top and bottom fabric strips extending from the edge of the said overlapping portion.

3. The brassiere according to claim 1, wherein the positive attachment means comprises at least one hook on the underside of the overlapping portion and at least one matching eye of the top side of the underlapping portion.

4. The brassiere according to claim 1, wherein a fabric loop for gripping is attached to the lower edge of the underlapping portion.

5. The brassiere according to claim 1, wherein the detachable and adjustable fabric fastening means and the support means are formed of hook and loop type fastener pads.

6. A front opening brassiere for easy access and removal by a handicapped person, said brassiere comprising:

brassiere cups having at least one joining piece extending around the back of a wearer;

one brassiere cup having a center underlapping portion, the other cup having a center overlapping portion which extends over the underlapping portion between the brassiere cups;

adjustable fabric fastening means, said means being disposed on the top side of the underlapping portion to engage with a corresponding support means located on the underside of the brassiere cup with the overlapping portion;

at least one positive attachment means between the underside of the overlapping portion and the top side of the underlapping portion, said positive attachment means being located adjacent said fabric fastening means;

at least one fabric loop extending from an edge of the overlapping portion to assist in gripping the overlapping portion of the brassiere cup for access or removal;

whereby said top and bottom fabric fastening means and corresponding support means, in conjunction with said fabric loop, are adapted to position said overlapping portion with respect to said underlapping portion to thereby facilitate the engagement and disengagement of said positive attachment means.

7. The brassiere according to claim 6, wherein said fabric fastening means comprises a plurality of fabric fastening pads disposed in a generally linear spaced apart relationship adjacent an edge of said underlapping portion.

8. The brassiere according to claim 7, wherein said corresponding support means is a continuous support pad disposed adjacent an edge of said overlapping portion.

9. The brassiere according to claim 8, wherein a plurality of said positive attachment means is provided adjacent said fabric fastening pads.

10. The brassiere according to claim 9, wherein a plurality of fabric loops is provided for gripping, each extending from an edge of the overlapping portion, and wherein at least one fabric loop is further provided for the underlapping portion to extend from an edge thereof.

11. The brassiere according to claim 10, wherein a corresponding plurality of positive attachment means is provided for the said plurality of fabric fastening pads, said plurality of positive attachment means being disposed in a generally linear spaced apart relationship adjacent said edge of said underlapping portion and between said fabric fastening pads and said edge.

12. The brassiere according to claim 11, wherein a corresponding plurality of fabric loops is provided for the said plurality of positive attachment means, said corresponding plurality of fabric loops being provided respectively for each of said underlapping and overlapping portions of said brassiere.

13. The brassiere according to claim 12, wherein three fabric fastening pads are provided, and wherein three corresponding fabric loops are provided on each of the underlapping and overlapping portions of said brassiere.

14. The brassiere according to claim 13, wherein the adjustble fabric fastening pads and the continuous support pad are formed of hook and loop type fasteners.

* * * * *